US010074495B2

(12) United States Patent
Sera et al.

(10) Patent No.: US 10,074,495 B2
(45) Date of Patent: Sep. 11, 2018

(54) SWITCH CASE AND SWITCH

(71) Applicant: Panasonic Intellectual Property Management Co., Ltd., Osaka (JP)

(72) Inventors: Naoki Sera, Okayama (JP); Masatsugu Takeuchi, Okayama (JP); Daisuke Nakata, Okayama (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 0 days.

(21) Appl. No.: 15/548,228

(22) PCT Filed: Feb. 22, 2016

(86) PCT No.: PCT/JP2016/000916
§ 371 (c)(1),
(2) Date: Aug. 2, 2017

(87) PCT Pub. No.: WO2016/136225
PCT Pub. Date: Sep. 1, 2016

(65) Prior Publication Data

US 2018/0019077 A1 Jan. 18, 2018

(30) Foreign Application Priority Data

Feb. 27, 2015 (JP) ..... 2015-038458

(51) Int. Cl.
*H01H 1/10* (2006.01)
*H01H 13/06* (2006.01)
*H01H 13/14* (2006.01)

(52) U.S. Cl.
CPC ..... *H01H 13/06* (2013.01); *H01H 13/14* (2013.01)

(58) Field of Classification Search
CPC ..... H01H 13/06; H01H 13/14
USPC ..... 200/302.1, 511–513, 516, 517, 275, 520, 200/521, 341
See application file for complete search history.

(56) References Cited

U.S. PATENT DOCUMENTS

2012/0145526 A1* 6/2012 Masuda ..... H01H 13/705 200/513
2014/0311882 A1* 10/2014 Terashita ..... H01H 13/10 200/520

FOREIGN PATENT DOCUMENTS

JP 2011-060627 3/2011

OTHER PUBLICATIONS

International Search Report of PCT application No. PCT/JP2016/000916 dated May 17, 2016.

* cited by examiner

*Primary Examiner* — Edwin A. Leon
*Assistant Examiner* — Lheiren Mae A Caroc
(74) *Attorney, Agent, or Firm* — McDermott Will & Emery LLP

(57) ABSTRACT

The switch case includes a metal plate having a first surface and a second surface that is at a side opposite to the first surface, and a resin case embedding a part of the metal plate. The resin case includes a housing portion having an opening formed on a surface of the resin case. The metal plate includes a terminal portion, a contact portion, and an intermediate portion positioned between the terminal portion and the contact portion. The terminal portion is exposed from the surface of the resin case, and the intermediate portion is embedded in the resin case. The intermediate portion is provided with at least one through-hole penetrating the first surface and the second surface. The contact portion includes a part of the first surface exposed to the housing portion of the resin case. In the at least one through-hole, the hole diameter of the at least one through-hole at the second surface is larger than the hole diameter of the at least one through-hole at the first surface.

20 Claims, 10 Drawing Sheets

SWITCH CASE AND SWITCH

This application is a U.S. national stage application of the PCT International Application No. PCT/JP2016/000916 filed on Feb. 22, 2016, which claims the benefit of foreign priority of Japanese patent application 2015-038458 filed on Feb. 27, 2015, the contents all of which are incorporated herein by reference.

TECHNICAL FIELD

The present disclosure relates to a switch case and a switch used for an operation unit of various electronic devices.

BACKGROUND

In recent years, various electronic devices have become smaller, lighter, and thinner. Along with these trend, a switch used for an operation unit of an electronic device has also been strongly demanded to become smaller and thinner.

For example, as shown in Unexamined Japanese Patent Publication No. 2011-60627, in the conventional switch, a switch case is formed by molding (insert molding) a case made of insulating synthetic resin in such a manner as to embed a metal member. The central fixed contact of the switch is constituted by a part of the metal member exposed from the inner bottom surface of the opening of the case. In addition, a portion different from the central fixed contact of the metal member protrudes outward from the side surface of the case. This portion constitutes a terminal.

SUMMARY

The present disclosure provides a switch case that suppresses infiltration of water and flux into the switch case while being a thin type, and a switch that uses the switch case.

The switch case of the present disclosure includes a metal plate having a first surface and a second surface that is at a side opposite to the first surface, and a resin case embedding a part of the metal plate. The resin case includes a housing portion having an opening formed on a surface of the resin case. The metal plate includes a terminal portion, a contact portion, and an intermediate portion positioned between the terminal portion and the contact portion. The terminal portion is exposed from the surface of the resin case. The intermediate portion is embedded in the resin case, and the intermediate portion is provided with at least one through-hole penetrating the first surface and the second surface. The contact portion includes a part of the first surface exposed to the housing portion of the resin case. In the at least one through-hole, a hole diameter of the at least one through-hole at the second surface is larger than a hole diameter of the at least one through-hole at the first surface.

According to the switch case of the present disclosure, the resin case comes into close contact with the metal plate more firmly. Therefore, the infiltration of water or flux into the housing portion from a gap between the resin case and the terminal portion can be suppressed.

DESCRIPTION OF EMBODIMENT

Prior to the description of the exemplary embodiment of the present disclosure, problems of the conventional switch case will be described.

In the conventional switch, when a small switch case is used, water and flux tend to infiltrate into the switch case through a slight gap between the resin member and the terminal.

In the following, an exemplary embodiment of the present disclosure will be described with reference to the accompanying drawings.

Figure 1:
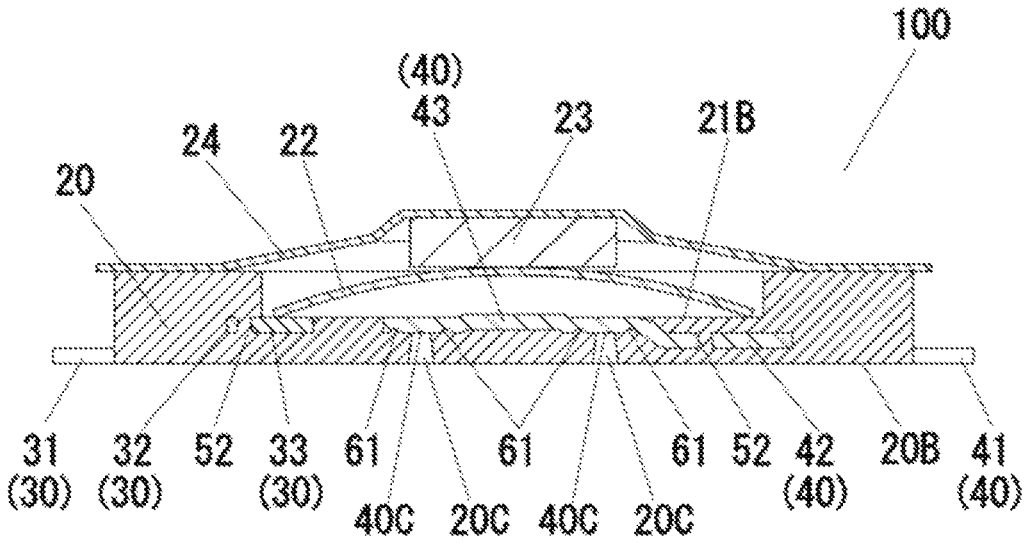
FIG. 1 is a cross-sectional view illustrating a switch in an exemplary embodiment of the present disclosure.
Figure 2:
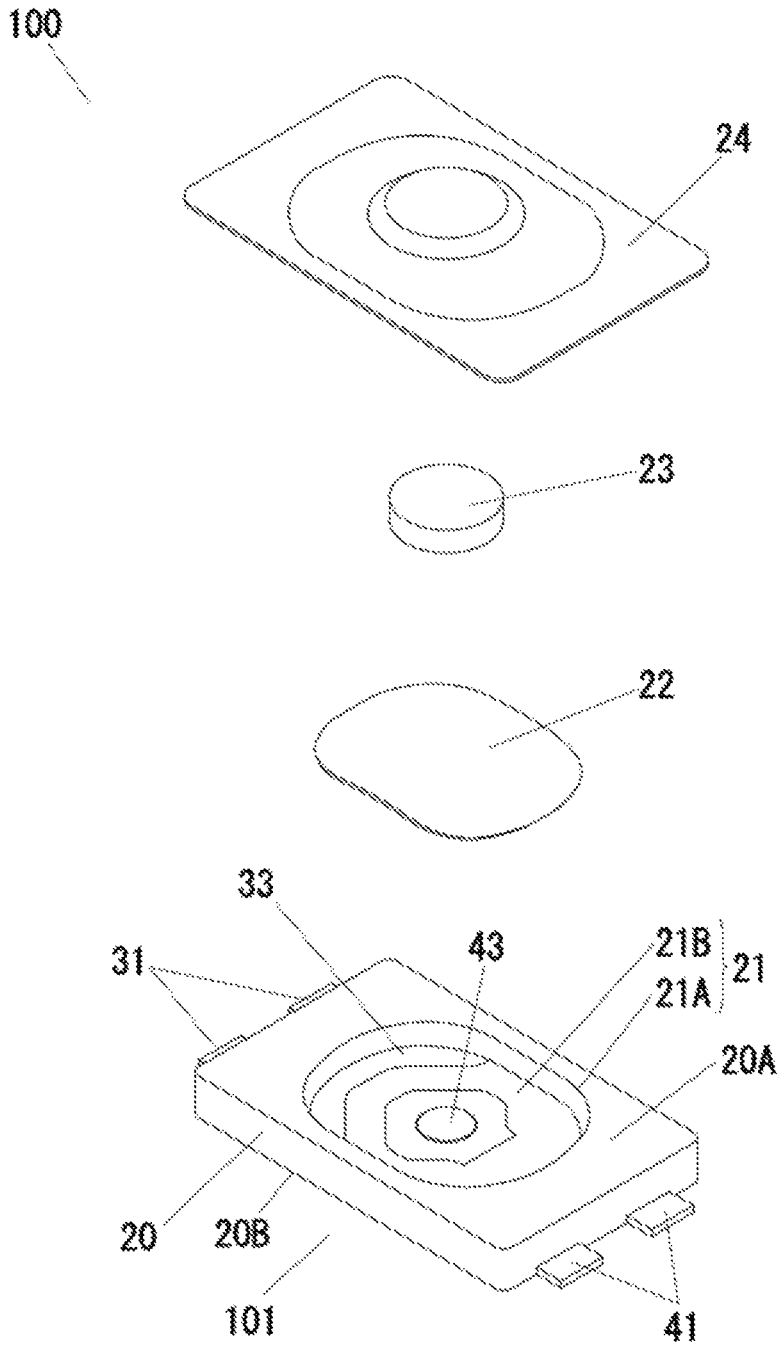
FIG. 2 is an exploded perspective view illustrating the switch in the exemplary embodiment of the present disclosure.

FIG. 1 is a cross-sectional view of switch 100 in the exemplary embodiment of the present disclosure. FIG. 2 is an exploded perspective view of switch 100.

As shown in FIGS. 1 and 2, switch 100 includes switch case 101, movable member 22, and protective sheet 24. Switch case 101 includes resin case 20 and first metal plate 30. In resin case 20, housing portion 21 is formed. Switch case 101 further includes second metal plate 40. Hereinafter, first metal plate 30 is referred to as metal plate 30, and second metal plate 40 is referred to as metal plate 40.

Figure 3:
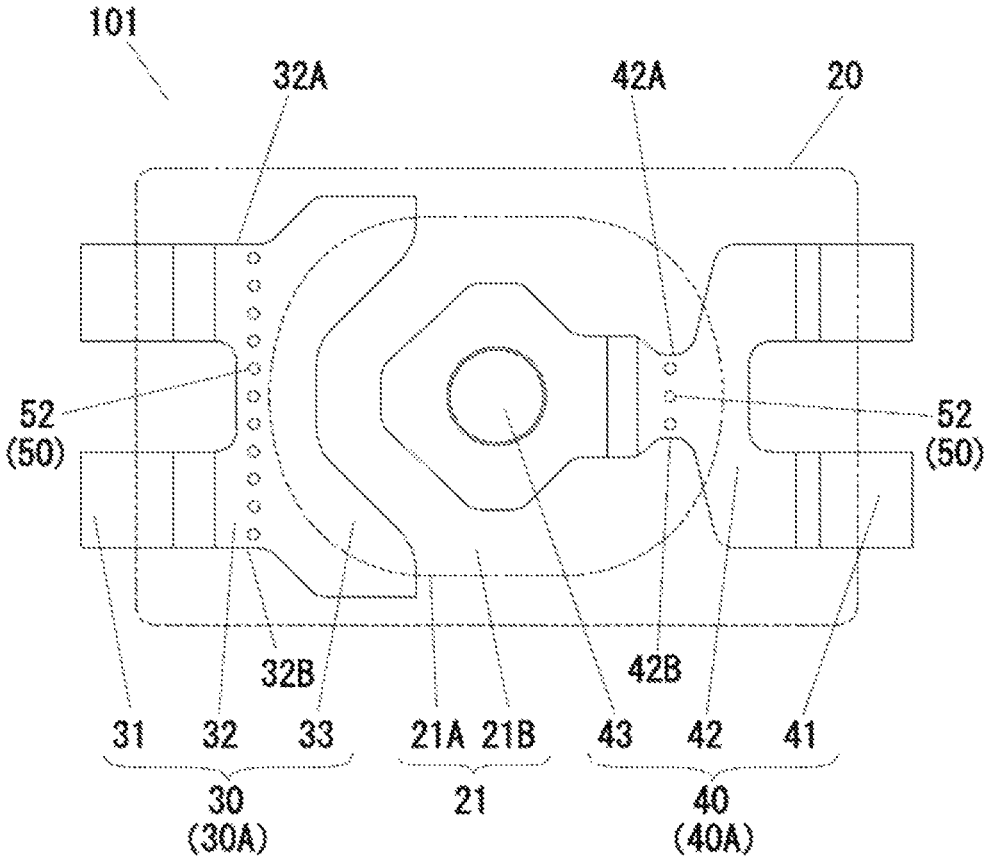
FIG. 3 is a top view illustrating a first metal plate and a second metal plate in the switch shown in FIG. 1.
Figure 4:
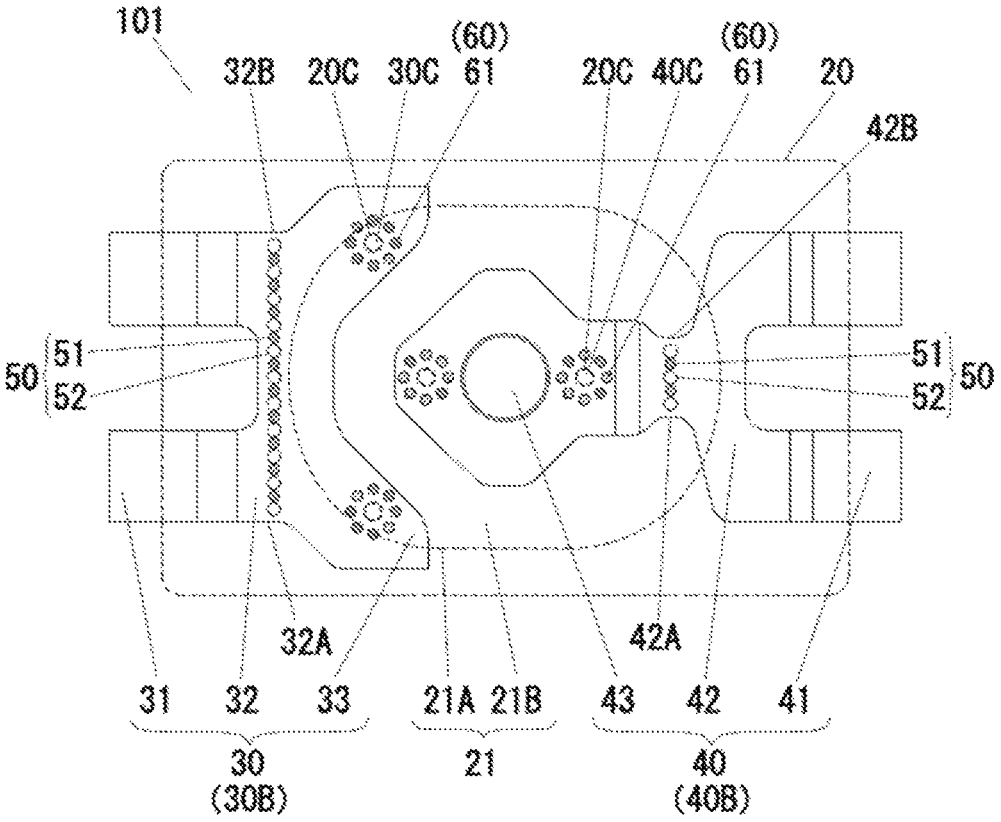
FIG. 4 is a bottom view illustrating the first metal plate and the second metal plate in the switch shown in FIG. 1.

FIG. 3 is a top view of metal plates 30, 40, and FIG. 4 is a bottom view of metal plates 30, 40. It should be noted that in FIGS. 3 and 4, in order to facilitate understanding of the configuration of metal plates 30, 40, resin case 20 is shown in a dashed line and metal plates 30, 40 are shown in solid lines. It should be noted that FIG. 3 is a view of switch case 101 as seen from first surface 30A side. FIG. 4 is a view of switch case 101 as seen from second surface 30B side.

Metal plate 30 has first surface 30A, and second surface 30B that is at a side opposite to first surface 30A. A part of metal plate 30 is embedded in resin case 20. Specifically, resin case 20 is formed on a surface of metal plate 30 by insert molding. Metal plate 30 includes first terminal portion 31, first contact portion 33, and first intermediate portion 32 positioned between first terminal portion 31 and first contact portion 33. Hereinafter, first terminal portion 31 is referred to as terminal portion 31, first intermediate portion 32 is referred to as intermediate portion 32, and first contact portion 33 is referred to as contact portion 33.

Terminal portion 31 is exposed from an outer surface of resin case 20. Intermediate portion 32 is embedded in resin case 20. Contact portion 33 includes a part of first surface 30A exposed to housing portion 21.

In intermediate portion 32, through-hole 52 penetrating from first surface 30A to second surface 30B is formed. In through-hole 52, hole diameter B at second surface 30B is larger than hole diameter A at first surface 30A. Since resin constituting resin case 20 is filled in through-hole 52, resin case 20 comes into close contact with metal plate 30 more firmly. Then, the infiltration of water or flux into housing portion 21 from the gap between resin case 20 and terminal portion 31 is suppressed.

In the following, switch case 101 will be described in detail.

In switch case 101, similarly to metal plate 30, metal plate 40 has first surface 40A, and second surface 40B at the side opposite to the first surface. Similarly to metal plate 30, metal plate 40 includes second terminal portion 41, second contact portion 43, and second intermediate portion 42 positioned between second terminal portion 41 and second contact portion 43. Hereinafter, second terminal portion 41 is referred to as terminal portion 41, second intermediate portion 42 is referred to as intermediate portion 42, and second contact portion 43 is referred to as contact portion 43.

In switch case 101, insulating resin case 20 is formed on metal plates 30, 40 by insert molding.

The shape of resin case 20 is, for example, a rectangular parallelepiped box. Resin case 20 has, for example, upper surface 20A, and bottom surface 20B disposed at a side opposite to upper surface 20A. Resin case 20 is provided with housing portion 21 having opening 21A formed on upper surface 20A. Housing portion 21 has a columnar cavity. In housing portion 21, bottom portion 21B is formed at an opposite end of opening 21A.

Figure 5:
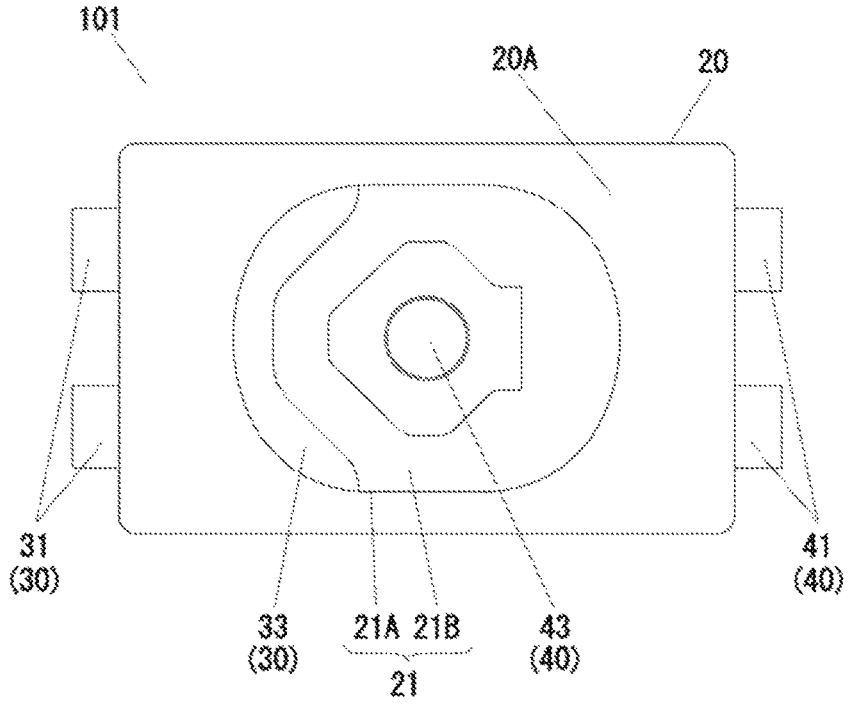
FIG. 5 is a top view illustrating the switch case shown in FIG. 2.

FIG. 5 is a top view of switch case 101.

As shown in FIG. 5, in switch case 101, each of contact portions 33, 43 is exposed at bottom portion 21B. As an example, contact portion 33 is arranged in such a manner as to be adjacent to a peripheral edge of bottom portion 21B. Contact portion 43 is disposed in a center of bottom portion 21B. Then, terminal portion 31 and terminal portion 41 respectively protrude outward from an outer side surface of resin case 20. Terminal portion 31 is mechanically and electrically connected to contact portion 33 through intermediate portion 32, and terminal portion 41 is mechanically and electrically connected to contact portion 43 through intermediate portion 42.

Figure 6:
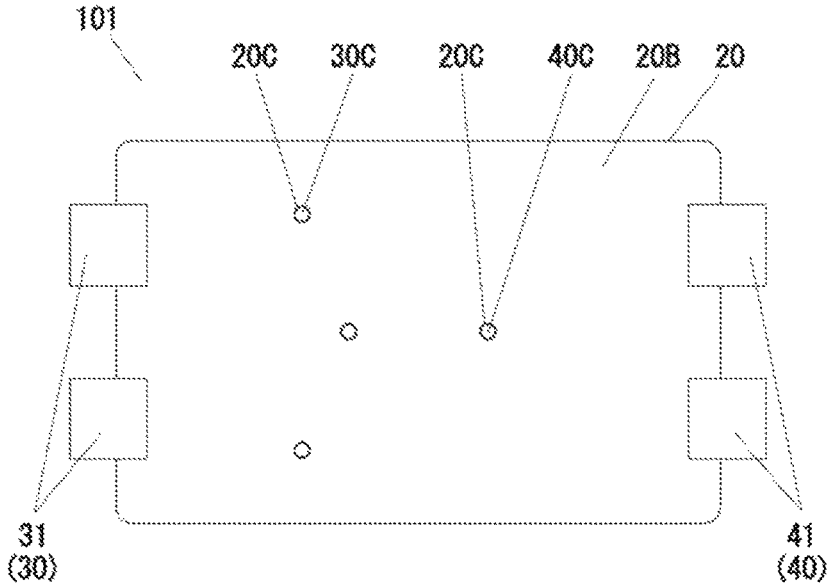
FIG. 6 is a bottom view illustrating the switch case shown in FIG. 2.

FIG. 6 is a bottom view of switch case 101.

As shown in FIGS. 1 and 6, at least one pin hole 20C opened on bottom surface 20B may be formed in resin case 20. In a manufacturing process of switch case 101, pin hole 20C is formed as a removed trace by removal of a support pin (not shown) from resin case 20. When resin case 20 and metal plates 30, 40 are formed by insert molding, the support pins fix the positions of metal plates 30, 40. Therefore, as shown in FIGS. 4 and 6, first exposed portion 30C which is a part of metal plate 30 and second exposed portion 40C which is a part of metal plate 40 are exposed from the respective pin holes 20C. Hereinafter, first exposed portion 30C is referred to as exposed portion 30C, and second exposed portion 40C is referred to as exposed portion 40C.

It should be noted that pin hole 20C may be blocked in order to prevent the infiltration of water or flux. The specific method for blocking pin hole 20C includes forming resin case 20 by insert molding then subsequently forming resin case 20 by insert molding again separately. That is, using a method such as twice molding allows a switch case, in which exposed portions 30C, 40C are not formed, to be manufactured.

Next, metal plates 30, 40 will be described in detail.

Each of metal plates 30, 40 is obtained by forming a thin metal plate having thickness T of, for example, from 30 μm to 100 μm, inclusive, so as to have a predetermined shape. In each of metal plates 30, 40, predetermined portions are bent to be formed.

Metal plate 30 is formed in a U shape as an example. Each of a pair of tips in the U shape constitutes terminal portion 31. An end opposite to terminal portion 31 constitutes contact portion 33. Metal plate 40 is formed in a Y shape as an example. A pair of ends branched in the Y shape constitute terminal portions 41. An end opposite to terminal portions 41 constitutes contact portion 43.

Each of intermediate portions 32, 42 is embedded in resin case 20. In metal plates 30, a surface including a portion exposed from bottom portion 21B to housing portion 21 is defined as first surface 30A. In metal plates 40, a surface including a portion exposed from bottom portion 21B to housing portion 21 is defined as first surface 40A. Contact portion 33 has a part of first surface 30A and constitutes a contact for electrically connecting with movable member 22. Contact portion 43 has a part of first surface 40A and constitutes a contact for electrically connecting with movable member 22.

It should be noted that as shown in FIGS. 3 and 4, first structural portion 50 including first recess 51 and through-hole 52 may be formed in each of intermediate portions 32, 42. Hereinafter, first structural portion 50 is referred to as structural portion 50, and first recess 51 is referred to as recess 51. Furthermore, as shown in FIG. 4, second structural portion 60 including a plurality of second recesses 61 may be formed around each of exposed portions 30C, 40C. Hereinafter, second structural portion 60 is referred to as structural portion 60, and second recess 61 is referred to as recess 61.

It should be noted that structural portions 50 formed in each of metal plates 30, 40 have the same function and structure as each other. Structural portions 60 formed in each of metal plates 30, 40 have the same function and structure as each other. Therefore, the same reference mark is given to each of the structural portions. Then, the same reference marks are also given to through-holes 52, recesses 51, 61, and the like formed in each of structural portions 50, 60. Furthermore, the detailed description of the following structural portions 50, 60 may also be described with only any one of metal plate 30 and metal plate 40 so as to avoid unnecessary duplication.

Figure 7:
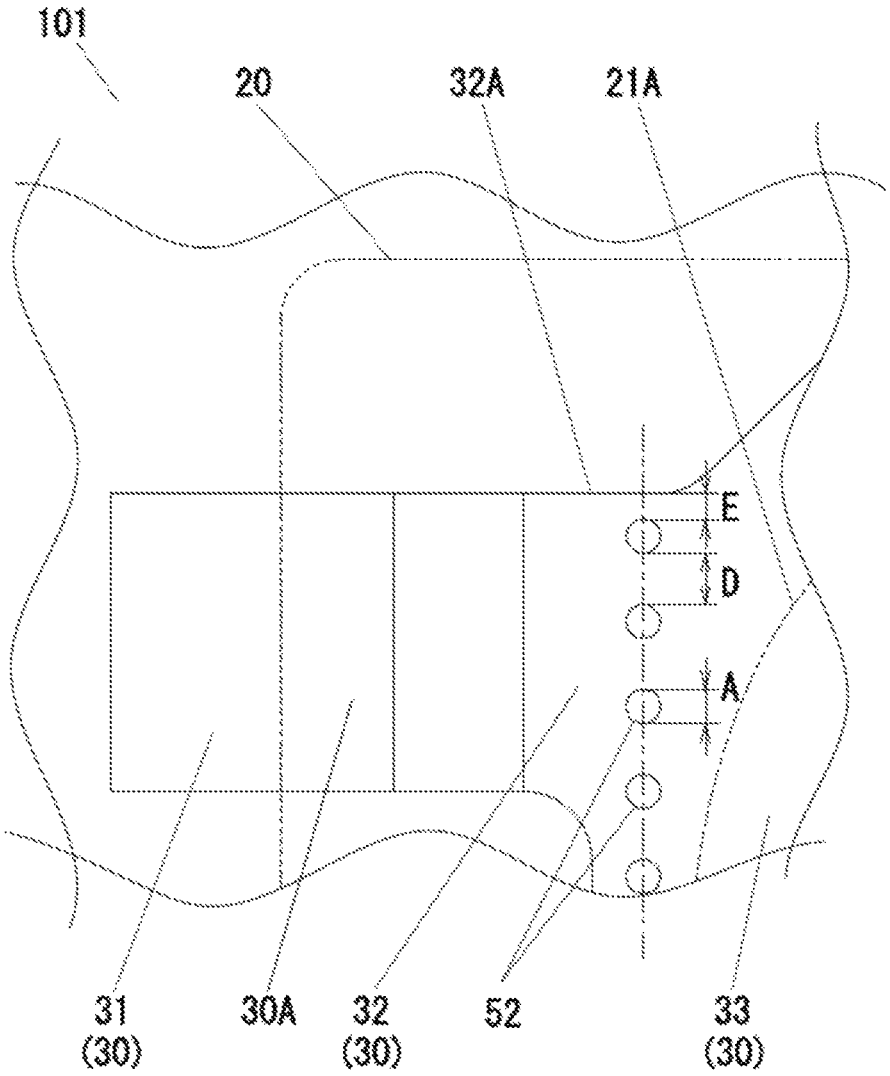
FIG. 7 is a top view partially illustrating the first metal plate shown in FIG. 3.
Figure 8:
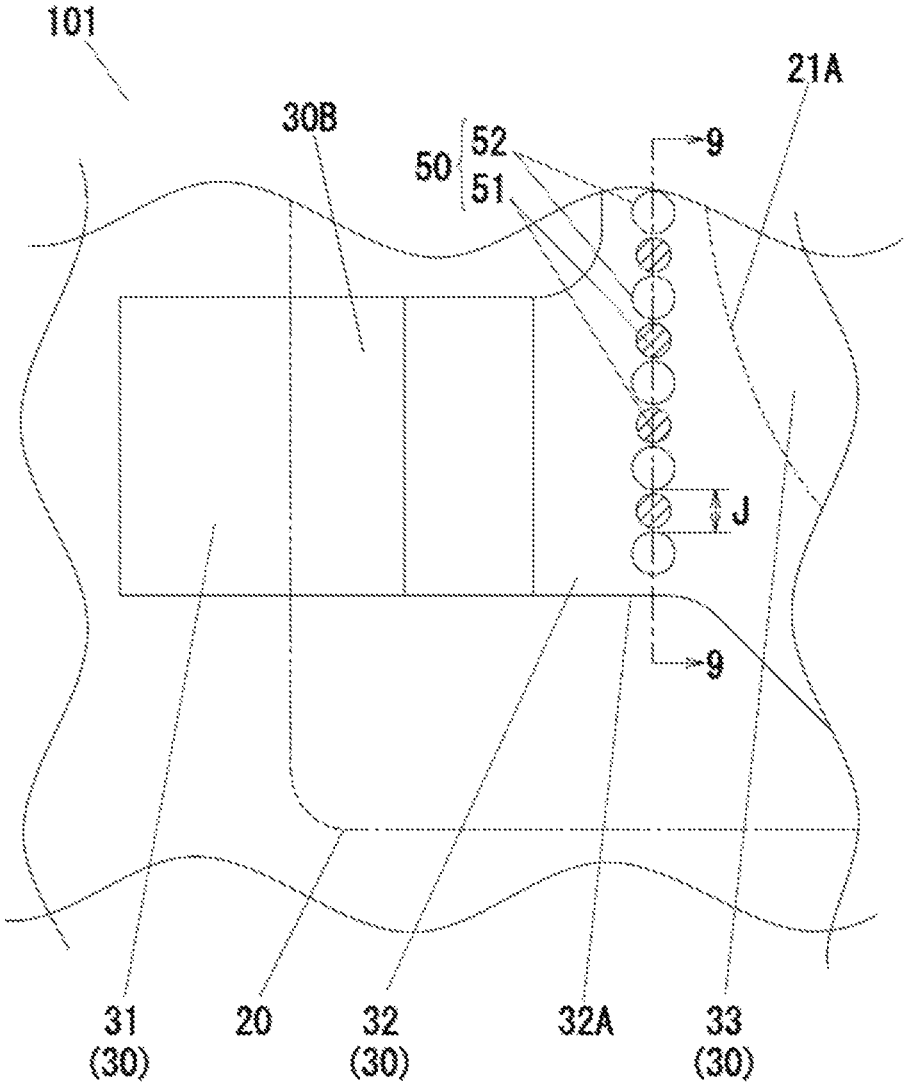
FIG. 8 is a bottom view partially illustrating the first metal plate shown in FIG. 4.
Figure 9:
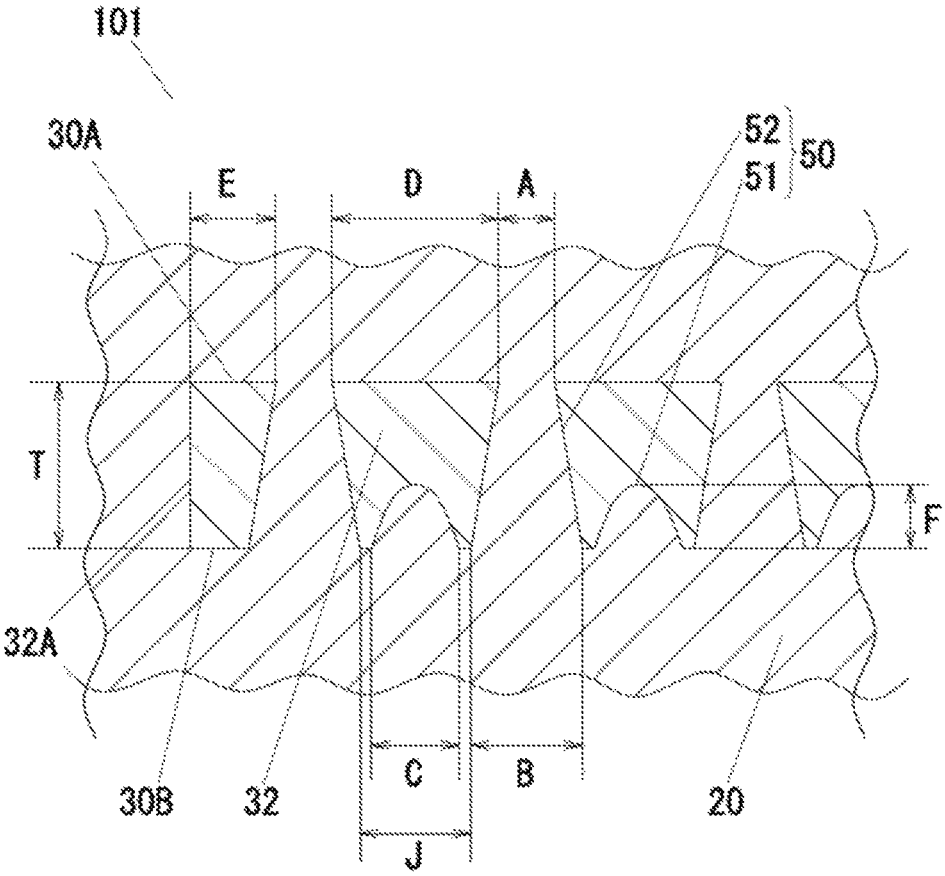
FIG. 9 is a cross-sectional view illustrating the first metal plate taken along line 9-9 shown in FIG. 8.

Next, the configuration of structural portion 50 will be described with reference to FIGS. 3, 4, and 7 to 9. FIG. 7 is a top view partially illustrating metal plate 30, FIG. 8 is a bottom view partially illustrating metal plate 30, and FIG. 9 is a cross-sectional view illustrating metal plate 30 taken along line 9-9 of FIG. 8. It should be noted that FIG. 7 is a view illustrating the main part viewed from first surface 30A, and FIG. 8 is a view illustrating the main part viewed from second surface 30B. In addition, in FIGS. 7 and 8, in order to facilitate understanding of the configuration of the main part, resin case 20 is shown in a dashed line and metal plate 30 is shown in a solid line.

As shown in FIG. 4, structural portion 50 includes recess 51 and a plurality of through-holes 52. Intermediate portion 32 includes first side surface 32A and second side surface 32B provided at both ends. Intermediate portion 42 includes first side surface 42A and second side surface 42B provided at both ends. As shown in FIGS. 3 and 4, in metal plate 30, a plurality of through-holes 52 are formed in such a manner as to line up from first side surface 32A to second side surface 32B. Furthermore, in a part of second surface 30B constituting intermediate portion 32, concavely recessed recess 51 is formed between adjacent through-holes 52. It should be noted that in FIGS. 4 and 8, recess 51 is hatched. In the same manner as metal plate 30, in metal plate 40, structural portions 50 are formed from first side surface 42A toward second side surface 42B.

As a method for forming through-hole 52, for example, a method for forming through-hole 52 by irradiating metal plates 30, 40 with a laser beam can be exemplified. Hereinafter, the forming method is referred to as a laser method. Through-hole 52 having a small hole diameter can be easily formed by the laser method. Furthermore, recess 51 may be formed by the laser method. By using the laser method, recess 51 having a smaller opening diameter than a recess formed by another method can be easily formed.

Then, as shown in FIG. 9, in through-hole 52, hole diameter B at second surface 30B is larger than hole diameter A at first surface 30A. The dimension of hole diameter A is preferably from 20 μm to 60 μm, inclusive. In addition, the dimension of hole diameter B is preferably from 30 μm to 80 μm, inclusive.

Furthermore, as shown in FIGS. 7 and 9, in structural portion 50, shortest distance D between the peripheries of the openings of adjacent through-holes 52 at first surface 30A (distance D) is, for example, from 40 μm to 150 μm, inclusive. Distance D is preferably from 50 μm to 100 μm, inclusive. In addition, on first surface 30A, shortest distance E from first side surface 32A to the periphery of through-hole 52 of intermediate portion 32 (distance E) is, for example, from 40 μm to 150 μm, inclusive. Distance E is preferably from 40 μm to 100 μm, inclusive.

As shown in FIGS. 8 and 9, recess 51 is recessed to be a shape similarly to the shape of a mortar. Hole diameter C of recess 51 is, for example, from 20 μm to 60 μm, inclusive. Depth F of recess 51 is, for example, from 5 μm to 30 μm, inclusive.

It should be noted that in FIGS. 7 and 8, the respective shapes of the openings of through-holes 52 at first surface 30A and at second surface 30B are illustrated as a circle. However, the shape of the opening is not limited to a circle. For example, the shape of the opening may be an ellipse or an oblong. When the shape of the elliptical opening is not circular, the maximum dimension of the opening of through-hole 52 only has to be the dimension of hole diameter A or hole diameter B. In addition, similarly to through-hole 52, the shape of the opening of recess 51 is not limited to a circle either.

It should be noted that a rough surface having fine unevenness may be formed on the inner surface of through-hole 52. An anchor effect or the like occurs between through-hole 52 and resin case 20 due to the above-described rough surface. Therefore, through-hole 52 comes into close contact with resin case 20 more firmly. A laser method can be used for forming through-hole 52 also from the viewpoint of the above-described anchor effect. In addition, the above-described rough surface may also be formed on the inner surface of recess 51 similarly to through-hole 52.

Through-hole 52 is preferably formed by the irradiation of second surface 30B with a laser beam. The above-described irradiation method allows the heat generated when a laser beam is applied to be suppressed from influencing a surface constituting a part of first surface 30 A in contact portion 33. This will be described in detail below.

When through-hole 52 or recess 51 is formed by the laser method, the portion irradiated with a laser beam reaches a high temperature due to heat generation. The heat generated in this case is transferred to a region other than the irradiated part in metal plate 30 by heat conduction. Therefore, the above-described region also reaches a high temperature.

In switch case 101, a laser beam is applied on second surface 30B. In other words, a laser beam is applied to a surface opposite to a surface serving as a contact point in electrical contact with movable member 22 (a part of first surface 30 A). When the heat generated by the laser method diffuses by heat conduction, a region affected by the heat of a laser beam at first surface 30A is smaller than a region reaching a high temperature due to heat conduction at second surface 30B which is irradiated with a laser beam, that is, a region affected by the heat of a laser beam at second surface 30B. That is, the influence of heat at first surface 30A is smaller than the influence of heat at second surface 30B. Therefore, irradiating second surface 30B with a laser beam allows a part of first surface 30A in contact portion 33 to be protected against the heat influence of the laser beam. Thus, protecting a part of first surface 30A allows the deformation of contact portion 33 or the elimination of antioxidant formed on a part of a surface of first surface 30A by heat to be suppressed.

Furthermore, setting the surface to be irradiated with a laser beam to second surface 30B allows recess 51 and through-hole 52 to be formed in one manufacturing process. Therefore, the manufacturing process or the manufacturing equipment can be simplified. In addition, structural portion 60 to be described below can also be formed at the same time.

As described above, switch case 101 where structural portion 50 is formed allows resin case 20 to be filled in through-hole 52 as shown in FIG. 9. Thus, improved contact property between intermediate portion 32 and resin case 20 can be achieved. Furthermore, as described above, in the present exemplary embodiment, the surface of recess 51 is formed on a rough surface on which fine unevenness is formed. Thus, recess 51 and resin case 20 come into close contact by the anchor effect or the like. Furthermore, since the inner side surface of through-hole 52 is also formed on a rough surface on which fine unevenness is formed by laser processing, the inner side surface of through-hole 52 and resin case 20 also come into close contact by the anchor effect or the like. Therefore, the contact property between intermediate portion 32 and resin case 20 can be increased to be achieved. Thus, the infiltration of water or flux from a slight gap between terminal portion 31 and resin case 20 into housing portion 21 can be suppressed.

It should be noted that in structural portion 50, recess 51 and through-hole 52 are arranged side by side in a straight line. However, the arrangement of recess 51 and through-hole 52 is not limited. For example, recess 51 and through-hole 52 may be arranged side by side along a curved line.

It should be noted that recess 51 is not always necessary. Structural portion 50 may include only a plurality of through-holes 52, for example. Not forming recess 51 allows a reduction in the cost for forming recess 51, suppression of a reduction in strength of metal plates 30, 40, and suppression of the influence of the laser method.

It should be noted that although structural portion 50 formed in metal plate 30 is mainly described in the above, the same applies to structural portion 50 formed in metal plate 40.

Next, structural portion 60 will be described.

Figure 10:
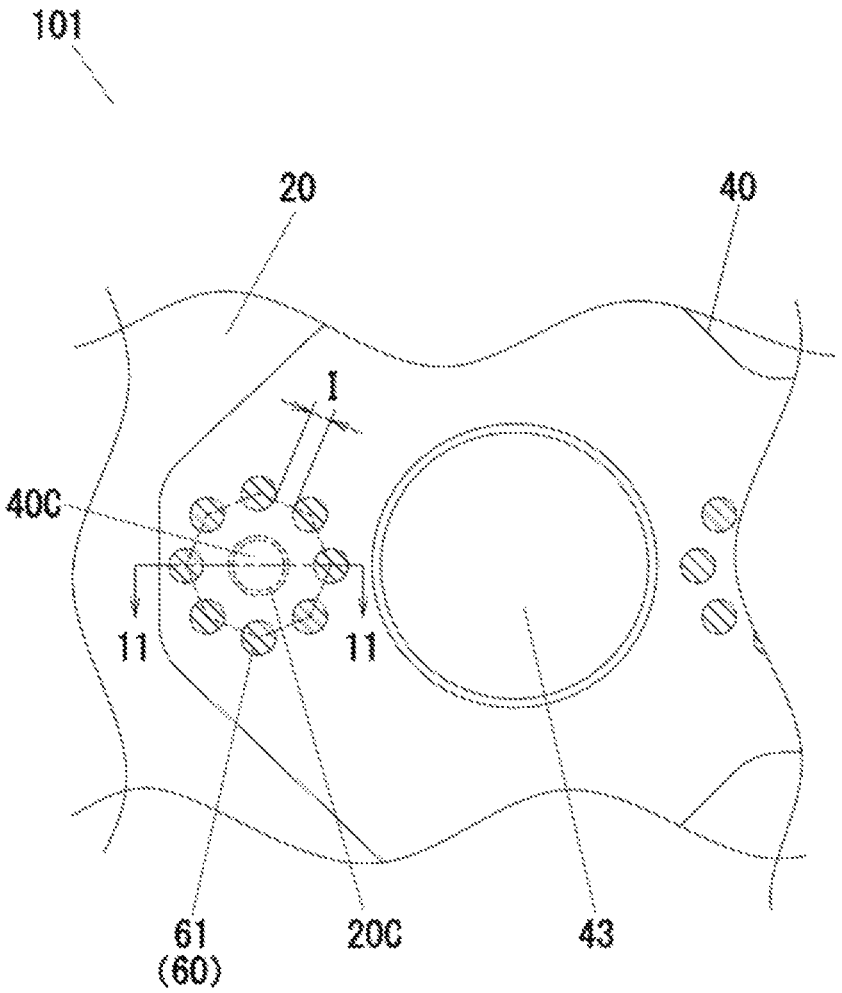
FIG. 10 is a bottom view partially illustrating the second metal plate shown in FIG. 4.
Figure 11:
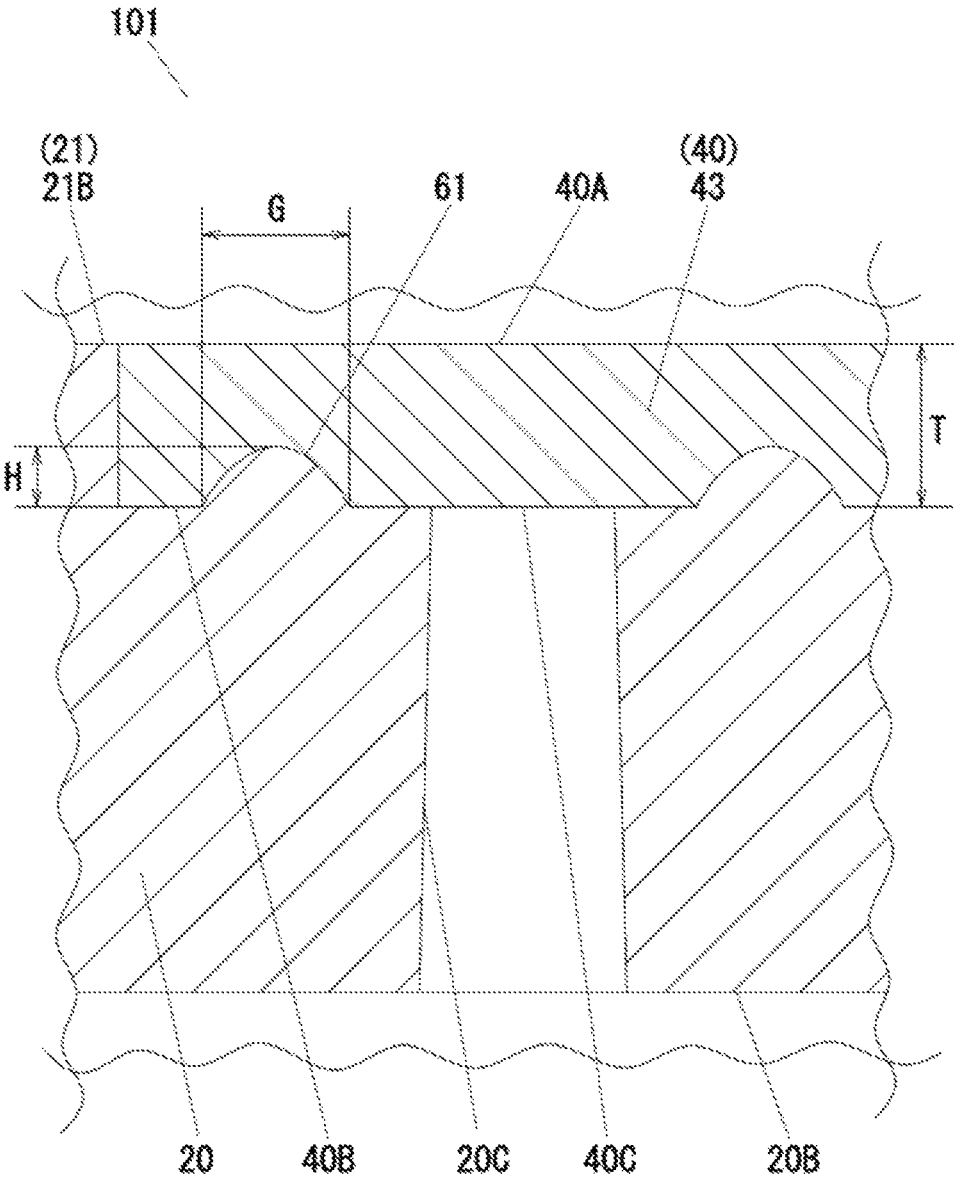
FIG. 11 is a cross-sectional view illustrating the second metal plate taken along line 11-11 of FIG. 10.

FIG. 10 is a top view partially illustrating metal plate 40. FIG. 11 is a cross-sectional view illustrating metal plate 40 taken along line 11-11 of FIG. 10. It should be noted that FIG. 10 is a view of metal plate 40 as viewed from second surface 40B side.

As shown in FIGS. 4 and 10, structural portion 60 includes a plurality of recesses 61. As shown in FIGS. 10 and 11, recess 61 is formed on second surface 40B. Recess 61 is recessed in a mortar shape having, for example, a circular opening. Then, the plurality of recesses 61 are arranged at equal angular intervals in such a manner as to surround each of exposed portions 40C. It should be noted that in FIGS. 4 and 10, recess 61 is hatched.

It should be noted that as shown in FIG. 4, in structural portion 60 formed in metal plate 40, all recesses 61 are formed in contact portion 43. On the other hand, in structural portion 60 formed in metal plate 30, a part of recesses 61 is formed in intermediate portion 32. That is, recess 61 only has to be formed in the portion embedded in resin case 20 on second surfaces 30B, 40B.

The method for forming recess 61 includes the laser method in the same manner as recess 51. Recess 61 having a small opening dimension can be easily formed by the laser method. Then, the laser method allows recesses 51, 61 and through-hole 52 to be simultaneously formed in one manufacturing process. Therefore, the manufacturing process or the manufacturing equipment can be simplified.

In the plurality of recesses 61 shown in FIG. 10, shortest distance I between the peripheries of the openings of adjacent recesses 61 (distance I) is, for example, from 0 μm to 60 μm, inclusive. More preferably, distance I is from 0 μm to 40 μm, inclusive. The case where distance I is 0 μm means that the peripheries of the openings of adjacent recesses 61 are overlapped with each other. As shown in FIGS. 10 and 11, hole diameter G of recess 61 is, for example, from 20 μm to 60 μm, inclusive. Depth H of recess 61 is, for example, from 5 μm to 30 μm, inclusive, and is smaller than the thickness of metal plate 40. Furthermore, in the same manner as recess 51, fine unevenness may be formed on the surface of recess 61. Recess 61 comes into close contact with resin case 20 more firmly due to fine unevenness. The fine unevenness can be formed by the laser method. It should be noted that, in the same manner as recess 51, the shape of the opening of recess 61 is not particularly limited. When the shape of the opening of recess 61 is not circular, the maximum dimension of the opening periphery of recess 61 may be the dimension of hole diameter G.

In addition, the plurality of recesses 61 only have to be arranged in such a manner as to surround exposed portion 40C. Therefore, for example, a plurality of recesses 61 may be arranged in such a manner as to constitute a plurality of concentric circles having different radii each of which is centered around the central part of exposed portion 40C, and the plurality of concentric circles may surround exposed portion 40C.

As described above, in structural portion 60, recess 61 can come into close contact with resin case 20 more firmly due to the anchor effect or the like around exposed portion 40C. Therefore, in switch case 101, the infiltration of water or flux from pin hole 20C into housing portion 21 can be suppressed.

It should be noted that although structural portion 60 formed in metal plate 40 is mainly described in the above, the same applies to structural portion 60 formed in metal plate 30.

In the following, switch 100 will be described in detail.

As shown in FIGS. 1 and 2, switch 100 further includes pressing body 23.

As shown in FIG. 1, movable member 22 is formed in an upwardly projecting dome shape. Movable member 22 is made of, for example, a thin metal plate having elasticity. Movable member 22 is held inside housing portion 21 with the outer peripheral edge of movable member 22 abutting on contact portion 33. The central part at the lower surface of movable member 22 faces contact portion 43 with spaced apart. Protective sheet 24 is made of an insulating film. Protective sheet 24 is disposed on upper surface 20A in such a manner as to cover opening 21A. The peripheral portion of protective sheet 24 is fixed to upper surface 20A. That is, housing portion 21 is sealed by closing housing portion 21 with protective sheet 24 hermetically. Protective sheet 24 is welded to resin case 20 by laser irradiation, for example. It should be noted that protective sheet 24 may be bonded to resin case 20 by using an adhesive or the like. Furthermore, the lower surface of protective sheet 24 is fixed to pressing body 23 made of an insulating resin. The lower surface of pressing body 23 is disposed on the center of the upper surface of movable member 22. Protective sheet 24 is also welded to pressing body 23 by laser irradiation. Switch 100 is configured as described above.

The operation of switch 100 will be described.

First, the central part of movable member 22 is pressed via pressing body 23 by pushing pressing body 23 downward via protective sheet 24. Then, movable member 22 is inverted by the press describes above. The lower surface of movable member 22 comes into contact with contact portion 43, and this yields conduction state between terminal portion 31 and terminal portion 41.

Then, when the pressing force is released, movable member 22 is restored to the original dome shape projecting upward by its own restoring force. Then, switch 100 returns to the OFF state in FIG. 1. Thus, movable member 22 functions as a movable contact.

As described above, switch case 101 and switch 100 can suppress water or flux from infiltrating into housing portion 21 by the improvement of the contact property between resin case 20 and metal plate 30 or the contact property between resin case 20 and metal plate 40.

It should be noted that the technical idea of the present disclosure is not limited to switches. For example, the technical idea can be applied to an electronic component such as an encoder where a resin case is formed in a metal plate by insert molding, and the electronic component including a contact portion exposed from inside the housing portion of the resin case, and a terminal portion exposed outside the resin case.

The switch case and the switch according to the present disclosure suppress the infiltration of water or flux into the switch case with improved contact property between the resin case and the metal plate. The switch case of the present disclosure is useful for an electronic component. Then, the electronic component is useful for an electronic apparatus.

The invention claimed is:

1. A switch case comprising:

a metal plate having a first surface and a second surface that is at a side opposite to the first surface; and a resin case embedding a part of the metal plate, wherein:

the resin case includes a housing portion having an opening disposed on a surface of the resin case, the metal plate includes:

a terminal portion which is exposed from the surface of the resin case, a contact portion which is exposed from the resin case in the housing portion, and an intermediate portion which is positioned between the terminal portion and the contact portion and is embedded in the resin case, the intermediate portion being provided with first and second through-holes each penetrating the first surface and the second surface, a hole diameter of the first through-hole at the second surface is larger than a hole diameter of the first through-hole at the first surface, and the first and second through-holes are positioned such that a line segment extending through centers of the first and second through-holes intersects a first side surface of the intermediate portion at a location embedded in the resin case, and the first through-hole is disposed closer to the first side surface than the second through-hole.

2. The switch case according to claim 1, wherein a thickness of the metal plate is from 30 μm to 100 μm, inclusive.

3. The switch case according to claim 1, wherein the hole diameter of the first through-hole at the second surface is from 30 μm to 80 μm, inclusive.

4. The switch case according to claim 1, wherein:

a plurality of through-holes including the first and second through-holes are provided in the intermediate portion, and a first recess that extends through only a partial thickness of the metal plate and is disposed on the second surface in the intermediate portion between two adjacent through-holes among the plurality of through-holes.

5. The switch case according to claim 4, wherein a depth of the first recess is 5 μm or more.

6. The switch case according to claim 1, wherein:

the intermediate portion further includes a second side surface that is at a side opposite to the first side surface, the first side surface and the second side surface being disposed between the first surface and the second surface, and a plurality of through-holes including the first and second through-holes are provided so as to line up from the first side surface to the second side surface.

7. The switch case according to claim 1, wherein a portion of the second surface, which constitutes the contact portion, includes:

an exposed portion exposed from the resin case, and a plurality of second recesses disposed around the exposed portion and each extending through only a partial thickness of the metal plate.

8. The switch case according to claim 7, wherein a depth of each of the plurality of second recesses is 5 μm or more.

9. A switch comprising:

the switch case according to claim 1; and a movable member held inside the housing portion, the movable member being electrically connected to the contact portion.

10. The switch according to claim 9, further comprising a protective sheet which covers the opening.

11. The switch case according to claim 1, wherein a hole diameter of the second through-hole at the second surface is larger than a hole diameter of the second through-hole at the first surface.

12. A switch case comprising:

a resin case that includes a housing portion having an opening disposed on a surface of the resin case, and a metal plate that includes a terminal portion which is exposed from a surface of the resin case, a contact portion which is exposed from the resin case in the housing portion, and an intermediate portion which is positioned between the terminal portion and the contact portion and is embedded in the resin case, wherein:

the intermediate portion includes:

a first surface, a second surface which is at a side opposite to the first surface, a first side surface which is disposed between the first surface and the second surface and is embedded in the resin case, a first recess of a plurality of first recesses which is disposed on the second surface, extends through only a partial thickness of the metal plate, and is embedded in the resin case, and a second recess of the plurality of first recesses which is disposed closer to the first side surface on the second surface than the first recess, extends through only a partial thickness of the metal plate, and is embedded in the resin case.

13. The switch case according to claim 12, wherein the intermediate portion further includes:

a second side surface which is at a side opposite to the first side surface and is embedded in the resin case, and a first through-hole which penetrates the first surface and the second surface, is disposed closer to the first side surface than the first recess, and is disposed closer to the second side surface than the second recess.

14. The switch case according to claim 13, wherein the first through-hole is located on a line segment connecting the first recess and the second recess.

15. The switch case according to claim 12, wherein the intermediate portion further includes at least two recesses of the plurality of first recesses which are disposed closer to the first side surface than the first recess, are disposed closer to the second side surface than the second recess, and each extend through only a partial thickness of the metal plate.

16. The switch case according to claim 12, wherein the intermediate portion further includes:

a third recess of a plurality of second recesses which is disposed closer to the terminal portion than the first recess on the second surface, extends through only a partial thickness of the metal plate, and is embedded in the resin case, a fourth recess of the plurality of second recesses which is disposed closer to the contact portion than the first recess on the second surface, extends through only a partial thickness of the metal plate, and is embedded in the resin case, wherein the metal plate further includes an exposed portion exposed from the resin case which is positioned closer to the terminal portion than the fourth recess, is positioned closer to the contact portion than the third recess, is positioned closer to the first side surface than the first recess, and is positioned closer to the first recess than the second recess.

17. A switch case comprising:

a resin case that includes a housing portion having an opening disposed on a surface of the resin case, and a metal plate that includes:

a terminal portion which is exposed from a surface of the resin case, a contact portion which is exposed from the resin case in the housing portion, and an intermediate portion which is positioned between the terminal portion and the contact portion and is embedded in the resin case, wherein:

the intermediate portion includes first and second through-holes each penetrating between a first surface and a second surface that is at a side opposite to the first surface of the metal plate, a dimension across the first through-hole at the second surface is larger than dimension across the first through-hole at the first surface, and the first and second through-holes are positioned such that a line segment extending through centers of the first and second through-holes intersects a first side surface of the intermediate portion at a location embedded in the resin case, and the first through-hole is disposed closer to the first side surface than the second through-hole.

18. The switch case according to claim 17, wherein a distance between the first and second through-holes is equal to or less than 150 μm.

19. The switch case according to claim 17, wherein a hole diameter of the second through-hole at the second surface is larger than a hole diameter of the second through-hole at the first surface.

20. The switch case according to claim 17, wherein the intermediate portion includes:

a second side surface that is at a side opposite to the first side surface, the first side surface and the second side surface being disposed between the first surface and the second surface, a first recess of a plurality of first recesses which is disposed closer to the second side surface than the first through hole on the second surface, extends through only a partial thickness of the metal plate, and is embedded in the resin case, and a second recess of the plurality of first recesses which is disposed closer to the first side surface on the second surface than the first through hole, extends through only a partial thickness of the metal plate, and is embedded in the resin case.

* * * * *